United States Patent [19]

Synofzik et al.

[11] Patent Number: 4,854,241

[45] Date of Patent: Aug. 8, 1989

[54] SPIN STABILIZED CARRIER PROJECTILE

[75] Inventors: Reinhard Synofzik, Juchen; Rolf Hellwig, Neuss; Klaus D. Karius, Juchen, all of Fed. Rep. of Germany

[73] Assignee: Rheinmetall GmbH, Düsseldorf, Fed. Rep. of Germany

[21] Appl. No.: 135,509

[22] Filed: Dec. 16, 1987

[30] Foreign Application Priority Data

Dec. 18, 1986 [DE] Fed. Rep. of Germany ..... 3643291

[51] Int. Cl.[4] ..... F42B 13/50

[52] U.S. Cl. ..... 102/489; 102/357; 102/386; 102/501

[58] Field of Search ..... 102/340, 342, 351, 357, 102/386, 387, 388, 393, 400, 354, 476, 501, 517, 489; 244/113, 3.1, 138, 142, 3.24, 3.27, 3.3

[56] References Cited

U.S. PATENT DOCUMENTS

| | | | |
|---|---|---|---|
| 2,364,197 | 12/1944 | Lee . | |
| 3,350,040 | 10/1967 | Sims | 244/113 X |
| 3,710,715 | 1/1973 | Hoofnagle . | |
| 4,215,836 | 8/1980 | Zacharin | 102/354 |
| 4,649,826 | 3/1987 | Stevens | 102/340 |
| 4,753,171 | 6/1988 | Stessen | 102/387 |

FOREIGN PATENT DOCUMENTS

| | | |
|---|---|---|
| 1703812 | 9/1974 | Fed. Rep. of Germany . |
| 3127071 | 1/1983 | Fed. Rep. of Germany . |

*Primary Examiner*—Harold J. Tudor

*Attorney, Agent, or Firm*—Spencer & Frank

[57] ABSTRACT

A spin stabilized carrier projectile comprising: a projectile body having a rear end; at least one submunition projectile disposed in, and ejectable from, the projectile body; and a projectile bottom disposed at, and ejectable from, the rear end of the projectile body, the projectile bottom having a side surface facing the submunition projectile and containing a recess, and a folded, expandable deceleration element for reducing the velocity and spin of the projectile bottom upon ejection from the projectile body, the deceleration element including a sheet of material fastened in the recess for producing air resistance, and the deceleration element being deployable from a folded condition to an expanded condition with the aid of rotation of the projectile bottom.

11 Claims, 3 Drawing Sheets

SPIN STABILIZED CARRIER PROJECTILE

BACKGROUND OF THE INVENTION

1. Field of the Invention

The present invention relates to a spin stabilized carrier projectile including at least one submunition projectile.

2. Discussion of the Prior Art

Such projectiles are disclosed, for example, in Flume, "Artilleriemunition: Bessere Wirkung im Ziel" [Artillery Ammunition - Better Effect On Target], in Wehrtechnik [Defense Technology], 1985, Volume 10, pages 112–120. In this example, the carrier projectile is shot with the aid of a cannon. The carrier projectile includes two or more target seeking submunition bodies which are ejected from the projectile at a given point in time. After ejection the submunition bodies initially decelerate and experience a reduction in spin. Customarily, the reduction in velocity is effected with the aid of a parachute and the spin is reduced with the aid of so-called spin fins. As soon as the velocity and spin of the submunition bodies have been reduced to preselected values, the spin fins and the parachute required to reduce the velocity are ejected, then another parachute opens and the submunition body floats to the ground while being able to perform the rotating movement for the purpose of scanning the target area.

The prior art spin stabilized carrier projectiles have always exhibited malfunctions in their operational sequences by the trailing bottom of the carrier projectile. After ejection, the bottom of this projectile often collides with the tail end of a submunition body and either damages it or makes it unstable.

Although there is prior knowledge which has proposed to prevent interference on the part of the projectile bottom in a spin stabilized payload projectile equipped with explosive heads by throwing back the projectile bottom as a result of an impact actuated by the opening deceleration anchor mechanism, such arrangement is relatively complicated and can be used only in special cases.

SUMMARY OF THE INVENTION

It is therefore an object of the present invention to develop a spin stabilized carrier projectile so that the bottom following the submunition projectiles, after their ejection from the carrier projectile, does not interfere with the submunition projectiles and does not require an impulse from an opening deceleration anchor mechanism of the submunition projectile.

The above and other objects are accomplished by the invention in which a spin stabilized carrier projectile comprising: a projectile body having a rear end; at least one submuntion projectile disposed in, and ejectable from, the prjectile body; and a projectile bottom disposed at, and ejectable from, the rear end of the projectile body, the projectile bottom having a side surface facing the submunition projectile and containing a recess, and a folded, expandable deceleration means for reducing the velocity and spin of the projectile bottom upon ejection from the projectile body, the deceleration means including a sheet of material fastened in the recess for producing air resistance, and the deceleration means being deployable from a folded condition to an expanded condition with the aid of rotation of the projectile bottom.

BRIEF DESCRIPTION OF THE DRAWINGS

The invention may be better understood by referring to the detailed description of the invention when taken in conjunction with the accompanying drawings in which.

DESCRIPTION OF THE PREFERRED EMBODIMENTS

Figures 1, 2A, 2B:
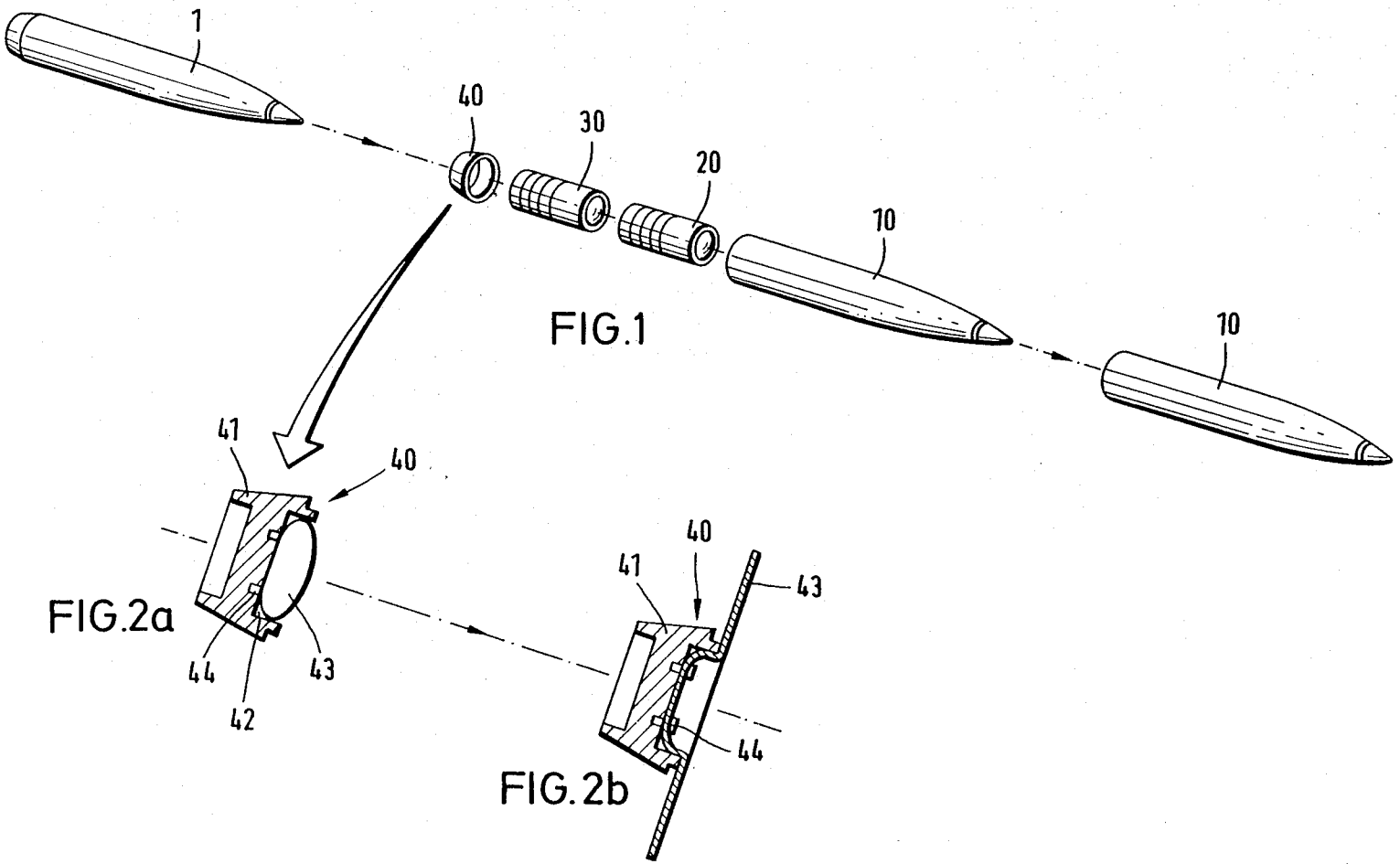
FIG. 1 shows schematically the time sequence of the process of ejecting the submunition bodies from the carrier projectile.
FIG. 2*a* is a cross-sectional side view of the projectile bottom with the deceleration element folded.
FIG. 2*b* is a cross-sectional side view of the projectile bottom with the deceleration element unfolded.

FIG. 1 disclosed a spin stabilized carrier projectile 1 which has been fired by a gun (not shown), for example. In the illustrated embodiment, this projectile 1 includes a projectile body 10, a projectile bottom 40, and two target seeking submunition bodies 20, 30 which are ejected from projectile 1 after a predetermined time. The submunition bodies are ejected in a known manner. After this ejection process the projectile body 10, the submunition bodies 20 and 30 and the bottom 40 of projectile 1 initially fly one behind the other. Unfolding of the deceleration elements (not shown) causes the velocity of the submunition bodies to be reduced to predetermined values. In the prior art, since the projectile bottom 40 continued to fly at a constant velocity, collisions frequently occurred between projectile bottom 40 and submunition body 30 and thus the flight behavior of these projectiles became unstable.

It is now proposed according to the invention, to provide projectile bottom 40 with a deceleration element 43.

FIG. 2*a* is a cross-sectional side view of projectile bottom 40. Projectile bottom 40 includes a generally metal bottom member 41, a cavity 42 disposed in the bottom member and the deceleration element 43 which is folded up in cavity 42 until submunition bodies 20 and 30 are ejected. The deceleration element 43 which is essentially composed of a woven fabric disc, e.g. of polyamide or of plastic sheeting of a corresponding tear strength, is screwed to bottom member 41 by means of screws 44.

FIG. 2*b* shows the deceleration element 43 in its unfolded state. The unfolding process occurs as follows: after ejection, submunition bodies 20 and 30 and projectile bottom 40 fly one behind the other without any mechanical connection between them. The spin of the projectile bottom 40 now pulls woven brake disk 43 outwardly and thus decelerates the rear flow surface or projectile bottom 40. Consequently, the projectile bottom 40 quickly lags behind submunition bodies 20 and 30 so that they can no longer be influenced by the projectile bottom 40.

Figure 3:
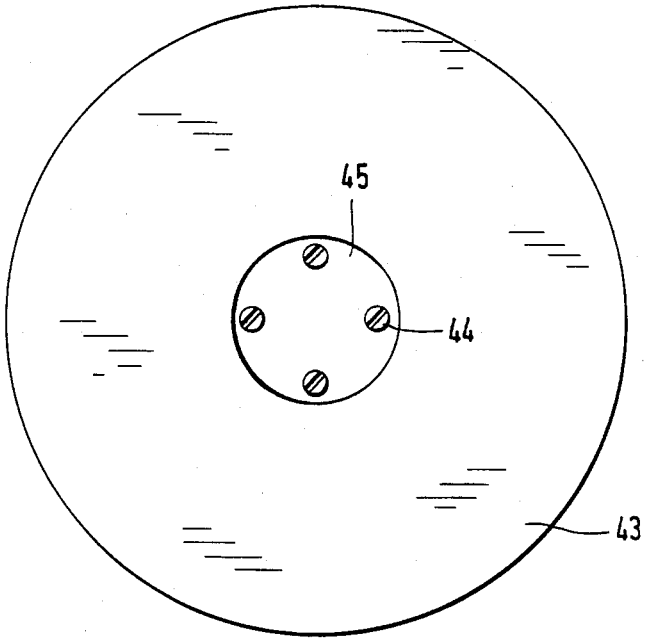
FIG. 3 is a top view of a first deceleration element according to the invention.

FIG. 3 is a top view of a first brake disk 43 according to the invention. The brake disk 43 is screwed to bottom member 41 by the fastening screws 44. Preferably, fastening screws 44 do not press directly against brake disk 43 but instead press against a disk 45 (e.g. made of metal) which evenly presses brake disk 43 against bottom member 41.

Figure 4:
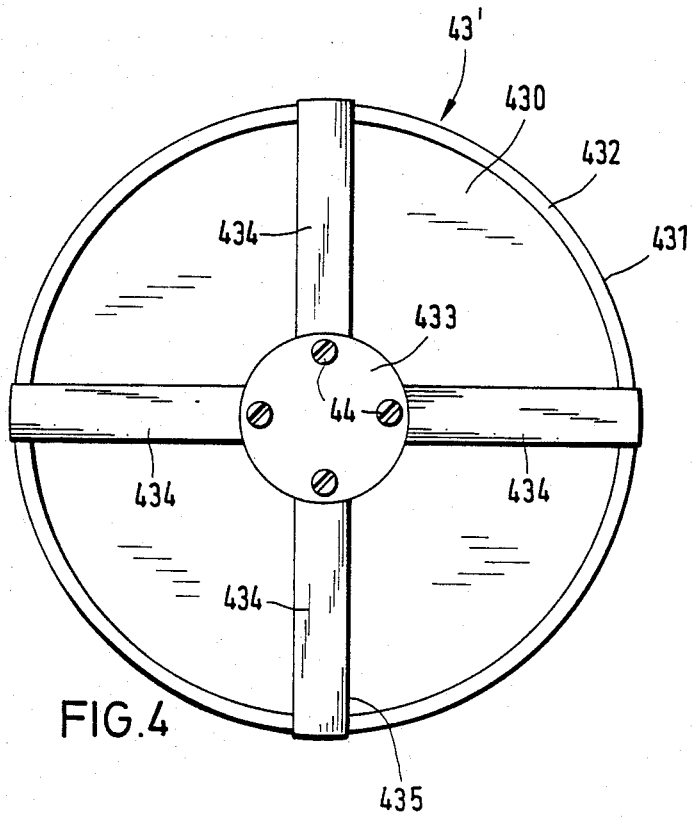
FIG. 4 is a top view of a second deceleration element according to the invention.

FIG. 4 shows a second brake disk 43' according to the invention. Brake disk 43' includes a main body 430 and an edge region 431. An edge reinforcement 432 is provided to prevent the edge region 431 of the brake disk 43' from tearing at the high rate of rotation of projectile bottom 40. FIG. 4 also includes a disk 433 similar in function to disk 45 in FIG. 3.

Further stability of the woven brake disk 43' is produced by additional strips of webbing 434 which are preferably arranged in a crosswise pattern. Polyamide has been found to be a particularly good material for the strips of webbing as well as for the edge reinforcement.

In this connection, it should be pointed out that the woven brake disk 43' need not necessarily be circular, as shown in FIGS. 3 and 4. Instead brake disk 43' may also have a hexagonal or octagonal shape.

It will be understood that the above description of the present invention is susceptible to various modifications, changes and adaptations, and the same are intended to be comprehended within the meaning and range of equivalents of the appended claims.

We claim:

1. A spin stabilized carrier projectile comprising:

a projectile body having a rear end;

at least one submunition projectile disposed in, and ejectable from, said projectile body; and a projectile bottom disposed at, and ejectable from, said rear end of said projectile body, said projectile bottom having a side surface facing said submunition projectile and containing a recess, and a folded, expandable deceleration means for reducing the velocity and spin of said projectile bottom upon ejection from said projectile body, said deceleration means including a sheet of material fastened in said recess for producing air resistance, and said deceleration means being deployable from a folded condition to an expanded condition with the aid of rotation of said projectile bottom.

2. A projectile as defined in claim 1, wherein said sheet of material is composed of a woven fabric.

3. A projectile as defined in claim 1, wherein said sheet of material is composed of plastic sheeting.

4. A projectile as defined in claim 1, wherein said deceleration means includes an edge region and said edge region is constructed such that it has a higher mass density than the remainder of said deceleration means.

5. A projectile as defined in claim 4, wherein said edge region includes an edge reinforcement.

6. A projectile as defined in claim 1, wherein said deceleration means includes strips of webbing for reinforcing said deceleration means.

7. A projectile as defined in claim 6, wherein said deceleration means has two sides and said strips of webbing are disposed on both of said sides.

8. A projectile as defined in claim 6, wherein there are at least two said strips of webbing crossed on said sheet of material.

9. A projectile as defined in claim 6, wherein said strips of webbing are composed of polyamide.

10. A projectile as defined in claim 1, wherein said sheet of material is composed of polyamide.

11. A projectile as defined in claim 1, wherein said deceleration means have a circular configuration when in said expanded condition.

* * * * *